US007472009B2

(12) United States Patent
Baldwin

(10) Patent No.: US 7,472,009 B2
(45) Date of Patent: Dec. 30, 2008

(54) METHOD AND APPARATUS FOR MONITORING A LOAD CONDITION OF A DRAGLINE

(75) Inventor: Geoff Baldwin, Brisbane (AU)

(73) Assignee: Leica Geosystems AG, Heerbrugg (CH)

( * ) Notice: Subject to any disclaimer, the term of this patent is extended or adjusted under 35 U.S.C. 154(b) by 789 days.

(21) Appl. No.: 10/974,781

(22) Filed: Oct. 28, 2004

(65) Prior Publication Data

US 2006/0085118 A1 Apr. 20, 2006

(30) Foreign Application Priority Data

Oct. 20, 2004 (AU) ..... 2004222734

(51) Int. Cl.
*G06F 7/70* (2006.01)

(52) U.S. Cl. ..... 701/50; 701/49; 172/4.5

(58) Field of Classification Search ..... 701/49, 701/50, 213, 301; 37/348; 172/4.5, 9
See application file for complete search history.

(56) References Cited

U.S. PATENT DOCUMENTS

| | | | | |
|---|---|---|---|---|
| 3,934,126 | A | | 1/1976 | Zalesov et al. |
| 4,035,621 | A | | 7/1977 | Kemp |
| 4,677,579 | A | | 6/1987 | Radomilovich |
| 4,809,794 | A | | 3/1989 | Blair et al. |
| 5,321,637 | A | | 6/1994 | Anderson et al. |
| 5,848,485 | A | * | 12/1998 | Anderson et al. ..... 37/348 |
| 5,964,822 | A | * | 10/1999 | Alland et al. ..... 701/301 |
| 6,072,127 | A | | 6/2000 | Oslakovic |

FOREIGN PATENT DOCUMENTS

| | | |
|---|---|---|
| GB | 2 252 642 A | 8/1992 |
| SU | 403 815 | 10/1973 |
| SU | 371 313 | 11/1973 |
| SU | 420 741 | 3/1974 |
| SU | 717 239 | 2/1980 |
| SU | 1406308 A1 | 6/1988 |

* cited by examiner

*Primary Examiner*—Gertrude Arthur Jeangla
(74) *Attorney, Agent, or Firm*—Oliff & Berridge, PLC

(57) ABSTRACT

A dragline includes a boom, a bucket, a hoist rope from which the bucket is suspended from the boom, and a drag rope for dragging the bucket. Data is produced on the alignment, with respect to a vertical plane containing the boom axis, of at least one of the following dragline components:

i) the hoist rope;
ii) the drag rope;
iii) the boom;
iv) the bucket.

This data can be used for controlling the load condition on the basis of the dragline.

The data can be inputted to a man-machine interface, e.g. a display device, controlled by a human operator, and/or it can be inputted to control the drive of the hoist rope and/or of the drag rope, so as to decrease or cease drive in response to detected misalignment of dragline component(s).

41 Claims, 9 Drawing Sheets

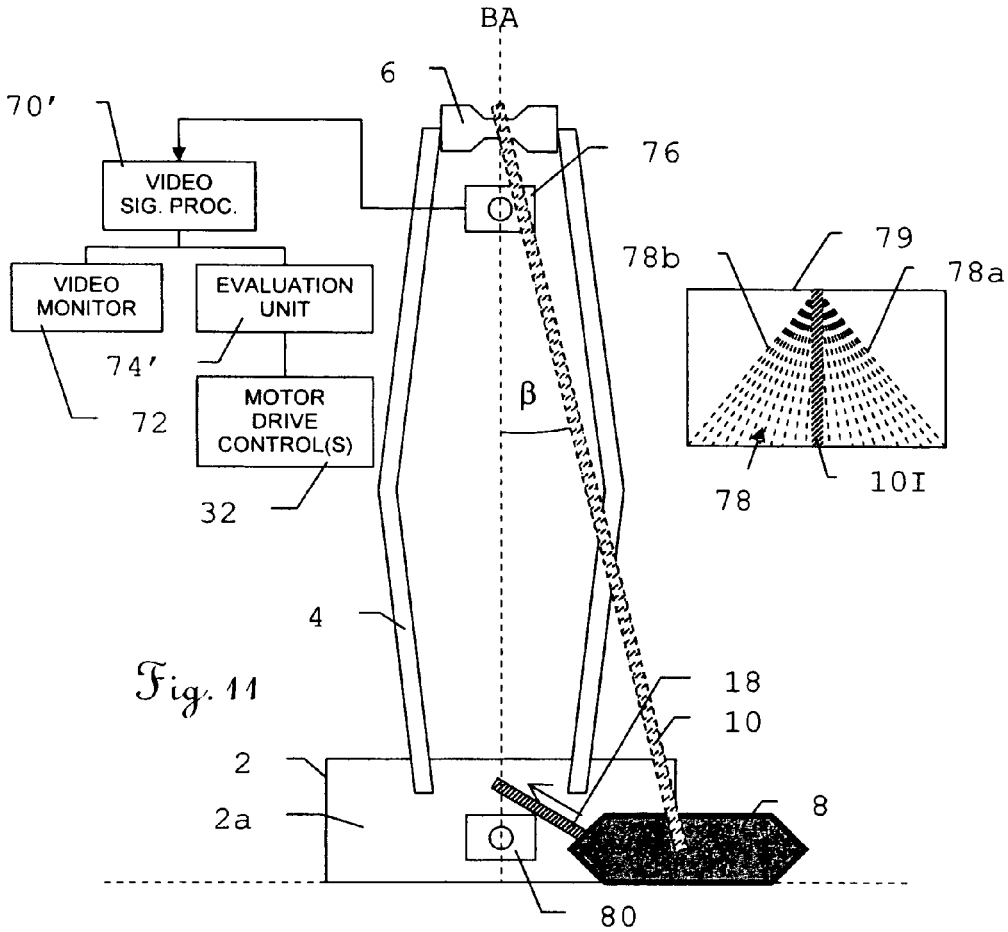
Fig. 11
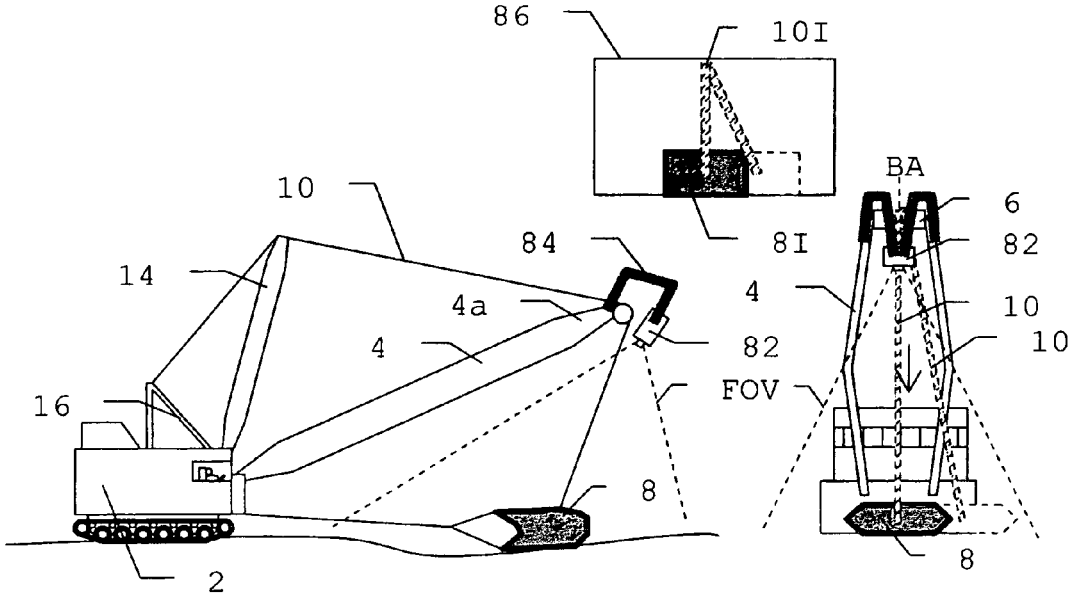
Fig. 12a
Fig. 12b

METHOD AND APPARATUS FOR MONITORING A LOAD CONDITION OF A DRAGLINE

BACKGROUND OF THE INVENTION

1. Field of the Invention

The present invention relates to draglines and electric shovels, such as used in open cast (or open cut) mining, and more particularly to a method and apparatus for monitoring their boom load conditions. In what follows, the teachings are given for a dragline, it being understood that they apply mutatis mutandis to an electric shovel. A dragline is a piece of machinery used for scooping ground material by means of a bucket suspended from a boom.

2. Description of Related Art

Figure 1:
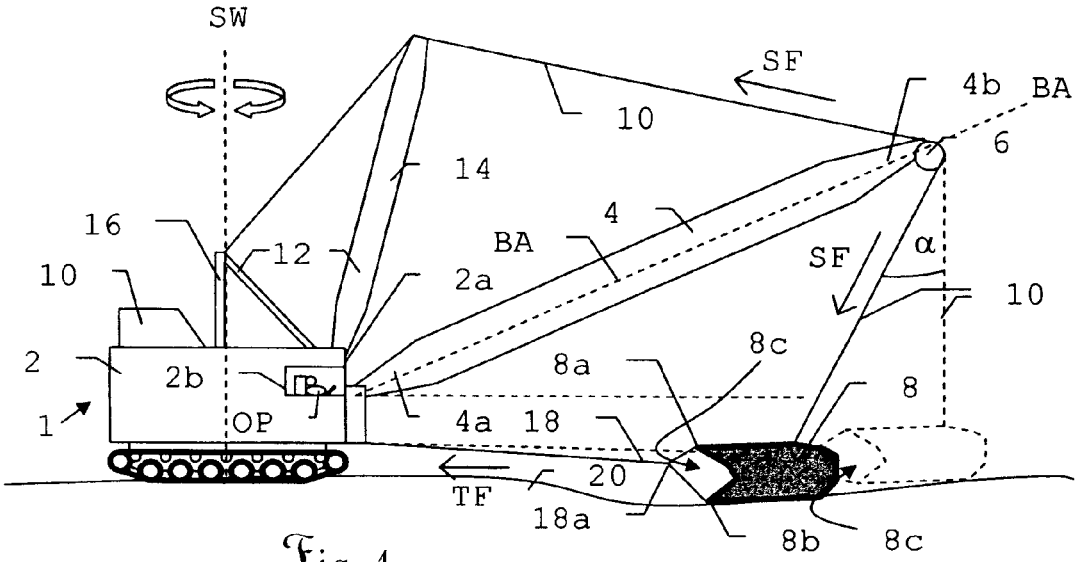

FIG. 1 is a simplified diagram of a classical dragline 1. It comprises a base unit 2, a boom 4 having a proximal end 4*a* depending from the base unit and a distal end 4*b* fitted with a pulley (also known as a sheave wheel) 6, from which a bucket 8 is suspended by a metal (steel) cable, referred to hereafter as a hoist rope 10. The base unit 2 comprises an elevated structure 12 for passing the hoist rope 10 to the pulley 6. In the example, this structure includes a mast 14 at the front portion (seen from the pulley) and stays 16, from which the hoist rope 10 connects to a drive point in the base unit 2. The hoist rope is thereby driven from a motor drive in the base unit to raise and lower the bucket 8 as required. The boom 4 can be driven to swing in an azimuthal (horizontal) plane by an electric swing motor, and thereafter blocked at a set azimuth. In the example, the swing axis SW passes through the base unit 2, the latter being mounted on rotary platform.

The bucket 8 is pulled towards base unit 2 substantially along the ground (horizontal) plane by another metal (steel) cable, referred to hereafter as a drag rope 18, to carry out the scooping action. The drag rope 18 is attached at one end 18*a* to anchoring points 8*a*, 8*b* of the bucket, so that bucket's opening 8*c* is kept horizontal and facing the base unit 2. The other end of the drag rope is connected to an electrically-driven winch (not shown) within the base unit 2.

In operation, the distal end 4*b* of boom 4 is initially positioned over the zone where material 20 is to be scooped, typically 70-100 m above the ground. The hoist rope 10 is initially adjusted to suspend the bucket 8 vertically (dotted lines) with its opening 8*c* confronting piled material 20 to be scooped. The drag rope 18 is then driven to exert a tractive force TF which drags the bucket along the ground plane, thereby picking up material 20 through the opening 8*c*. At the same time, the portion of the hoist rope 10 hanging from the pulley 6 is lengthened to maintain the bucket suspended following along the horizontal path of the ground. After the bucket has been dragged over a certain distance, filled, and lifted at some distance above the ground by hoist rope, the boom 4 is swung to place the bucket over a dumping zone.

The bucket is then arranged to drop the material, e.g. by tilting the bucket using an appropriate mechanism.

The dragline constitutes a large scale structure, with a boom length of 80 meters or more and a bucket capacity of up to 250 tonnes. The forces exerted on the boom 4 result from a combination of the tractive force TF exerted by the drag rope 18 and the suspending force SF exerted on the hoist rope 10. In particular, the hoist rope transfers a very high load to the boom, notably during the hoisting phases for lifting and during swinging of the boom.

Figure 2:
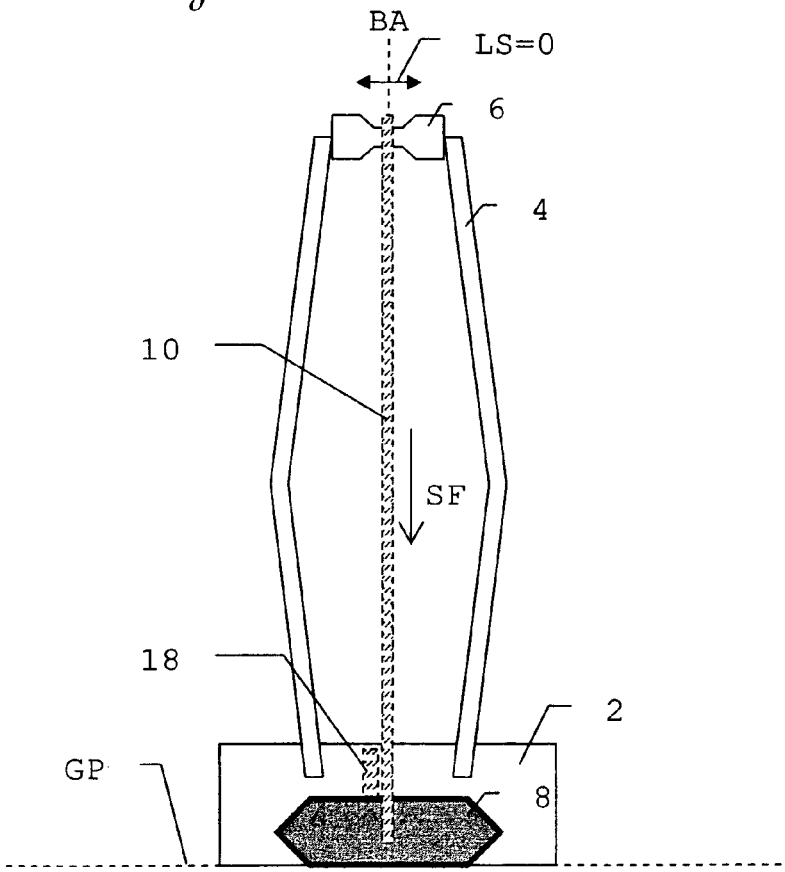

Under ideal operating conditions, the bucket 8, hoist rope 10 and drag rope 18 are maintained in azimuthal alignment with the principal axis of the boom BA (boom axis), i.e. the boom, hoist rope and drag rope are kept substantially in the same general plane, in alignment with the horizontal projection of the boom, as shown in FIG. 2. These alignments should ideally be maintained as the bucket 8 is pulled and the hoist rope 10 thereby subtends an evolving angle $\alpha$ (FIG. 1) with the vertical in the vertical plane containing the boom 4. In this way, the forces TF and SF on the boom are coplanar with the boom and exert a compressive force on its structure. In particular, the lateral stress LS on the boom, which would exert a lateral bending moment, is zero under those ideal conditions.

To meet the load demands, the boom 4 constitutes a complex mechanical structure made of steel, typically as a trellis box frame. The boom is a major limiting factor in the production rate of the dragline.

If the boom is overloaded, it will crack and cause downtime on the machine. If it is badly overloaded, it will cause complete failure of the structure. This is a major safety issue within a mine and can result in a fatal accident.

The boom 4 is usually specified for operation under these idealized working conditions, notably as regards its safe working load limits. With a proper control of the stresses within the boom structure, it would be possible to allow for a controlled overload of the dragline. This would give an improvement in output for a very low extra cost. Savings in terms of work efficiency under these circumstances can be typically on the order of hundreds of thousands of dollars per year per dragline.

It is known in the art to equip the boom with strain gauges at critical points to provide the dragline operator with a computer display showing stress-related parameters. This method, however, has the disadvantage of requiring rather complex calculations based on the boom structure characteristics, which may vary from one dragline to another.

SUMMARY OF THE INVENTION

The present invention is based on considering the real working conditions, and more particularly the observation that the aforementioned ideal coplanar alignment conditions of the boom 4 with the hoist rope 10 and/or the drag rope 18 and/or the bucket 8 are not always maintained.

Indeed, the bucket 8 can be dragged, and then hoisted, while it is out of alignment with the plane of the boom axis BA. This can arise since, even if the bucket's stable equilibrium point is in alignment with the boom axis when placed on the ground, it does not always advance smoothly when being dragged. For instance, the bucket can slide sideways on a slanted ground profile or the swing motors of the dragline can be activated while the bucket still has ground contact. Both—and other—effects can take the bucket some distance to one side or the other of the boom axis. This misalignment is a key issue notably during the hoisting and swinging phases for emptying the bucket 8.

Figure 3A:
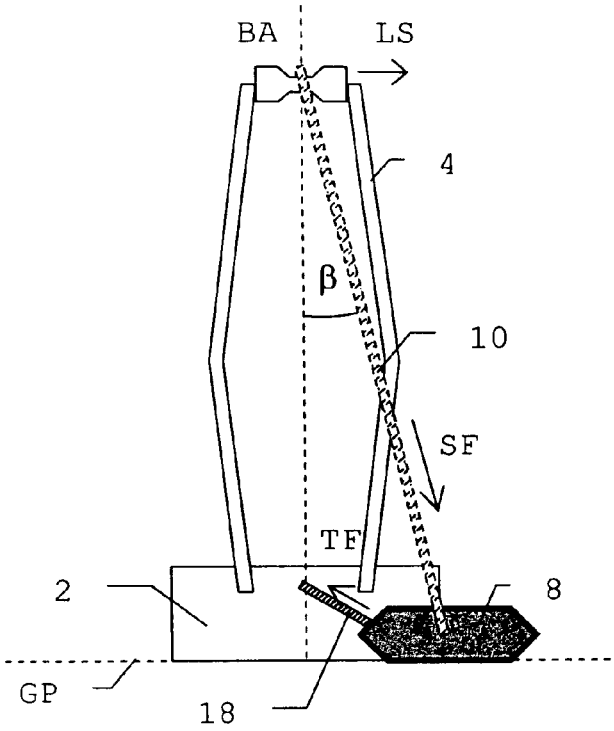
Figure 3B:
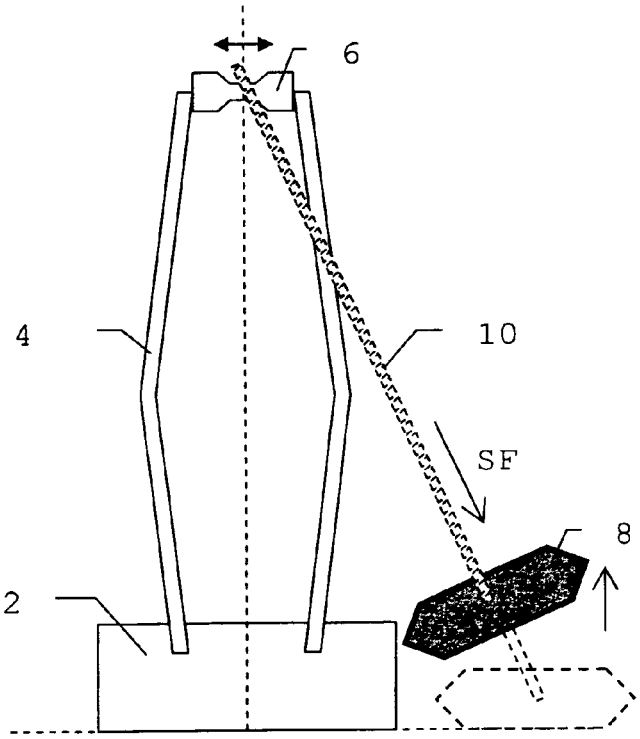
Figure 3C:
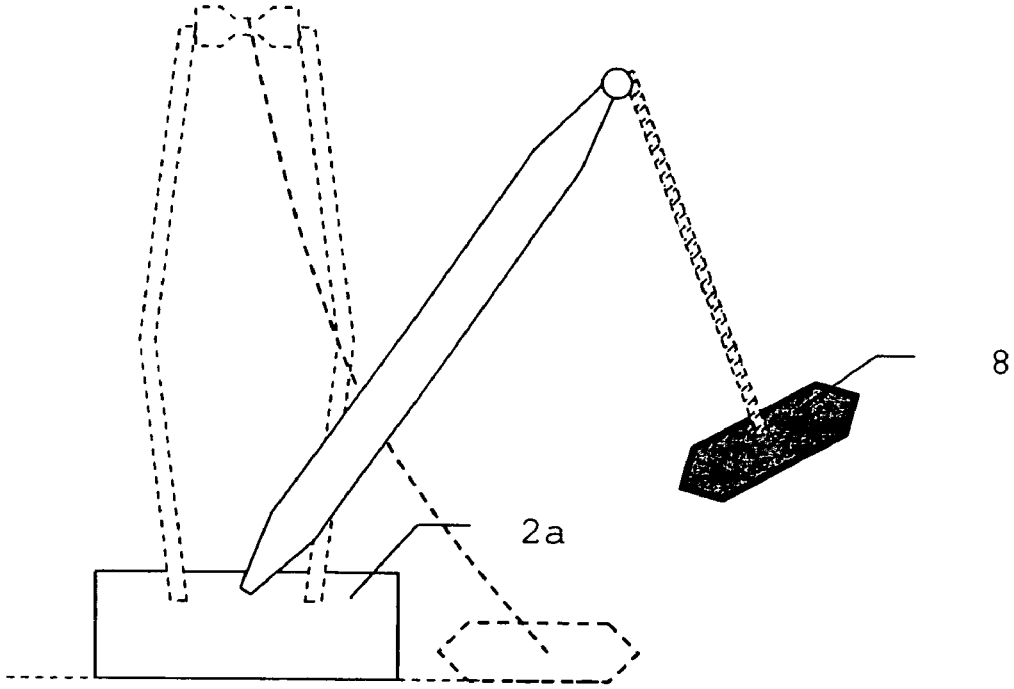

This situation is illustrated schematically in FIGS. 3*a*, 3*b* and 3*c*, which illustrate respectively a laterally misaligned bucket 8 and hoist rope 10 during the scooping operation (bucket along the ground), during a bucket hoisting operation, and a boom/bucket swing operation. As shown in FIG. 3*a*, the hoist rope 10 is laterally misaligned by an angle $\beta$ with respect to the vertical alignment of the boom axis BA. The force SF on that hoist rope thus creates on the boom 4 a lateral stress LS proportional to SF*sin $\beta$. When the hoist rope is raising the bucket and subsequently swinging it to a dumping point, the full weight BW of the suspended bucket and payload is applied to the distal end of the boom, with a consequently large lateral force component SF.

The risk of dangerous levels of lateral force LF is both of material damage to the boom and its fixtures, e.g. the mast 14 and stays 16 of the elevated structure 12 and to personnel operating in the vicinity should the boom become damaged or break. It is to be noted that a dragline boom 4 is of considerable cost to repair or replace, owing to its large size and special construction, and moreover the downtime on a dragline is also very costly in terms of lost production.

In view of the foregoing, the present invention seeks to assess the alignment/misalignment conditions of the boom, ropes and bucket, enabling to have at disposal critical information about the out of plane forces being applied to the dragline structure, or equivalently on an electric shovel.

The present invention offers a method and apparatus for automatically monitoring that the aforementioned alignment conditions with the plane of the boom axis, or equivalently on an alignment axis of an electric shovel.

More particularly, the invention provides, according to a first object, a method of monitoring a load condition of a dragline or an electric shovel, the dragline comprising a boom, a bucket, a hoist rope from which the bucket is suspended from the boom, and a drag rope for dragging the bucket, the boom extending substantially along a boom axis in its normal, unstressed state, characterised in that it comprises the step of:

using technical means to produce alignment data indicative of the alignment, with respect to the plane containing said boom axis, of at least one of the following dragline components:

i) the hoist rope, ii) the drag rope, iii) the boom, iv) the bucket.

Optional aspects are presented as follows.

The method can be implemented as a method of controlling a load condition of a dragline or electric shovel, by further comprising a step of controlling the aforementioned load condition of the dragline or electric shovel on the basis of the alignment data.

The alignment data can be inputted to a man-machine interface, e.g. a display device, whereby the controlling step is performed via a human operator.

The alignment data can be inputted to automated control means for controlling at least one of:

i) the drive motor(s) of the hoist rope, ii) the drive motor(s) of the drag rope, iii) the drive motor(s) of the boom, for swinging the boom, to perform the controlling step.

The controlling step can be performed substantially in real time using a feedback of the alignment data.

The controlling step can be performed in a combined manner by a human operator via a man-machine interface and by automated control means.

The controlling step can comprises authorizing a controlled overload of the dragline or electric shovel, notably when controlling a maximum structure stress thereon, as a function of the alignment data.

The method can be implemented with a boom having a specified maximum load limit, wherein the controlling step can comprise authorizing a controlled overload of the boom above that specified load limit as a function of the alignment data.

In one embodiment the information on the alignment/misalignment is fed into the dragline or electric shovel control system to automate the response to a thus-detected overload condition, and to control the maximum structure stress. In this way, the controls can be slowed or otherwise modified intelligently to ensure that there is no excessive stress (dangerous level of stress) while applying a controlled overload above standard manufacturers' limits.

The technical means can be used to produce the alignment data as quantitative data indicative of an amount of misalignment in at least one aforementioned dragline component.

The alignment data can be obtained by measurement on a pulley along which the hoist rope passes to hang from a distal end of the boom.

The pulley can be configured to sway (i.e. tilt or lean sideways) in response to a lateral stress from the hoist rope, and the alignment data can be obtained by determining the amount of sway of the pulley.

The alignment data can be obtained by measuring a lateral stress exerted on the pulley, e.g. by strain gauge means on the pulley structure.

The alignment data can be obtained by physical contact with at least one aforementioned dragline component.

The method can comprise physically engaging the hoist rope with an angular or linear displacement sensor device.

The alignment data can be obtained by detecting a lateral deflection of the boom from the boom axis.

The lateral deflection can be detected by producing an optical beam from a source attached to the boom, preferably at or near a distal end, and detecting a displacement of the beam spot where it impinges a target.

The alignment data can be obtained by imaging at least one dragline component.

The method can comprise imaging the hoist rope using camera means.

The alignment data can be obtained by analysing coordinate data from GPS receiver means, at least one GPS receiver being positioned on the boom.

The alignment data can be obtained by surveying techniques, to determine coordinate evolutions of a portion of the boom susceptible of deflecting laterally with respect to its boom axis.

The method can comprise surveying a target substantially at the distal end of the boom using a surveying device, preferably a self-tracking total station placed at a known reference point on the dragline.

According to a second aspect, the invention relates to an apparatus for monitoring a load condition of a dragline or an electric shovel, the dragline comprising a boom, a bucket, a hoist rope from which the bucket is suspended from the boom, and a drag rope for dragging the bucket, the boom extending substantially along a boom axis in its normal, unstressed state, characterised in that it comprises means for producing alignment data indicative of the alignment, with respect to the plane containing the boom axis, of at least one of the following dragline components:

i) the hoist rope, ii) the drag rope, iii) the boom, iv) the bucket.

The optional aspects presented above in the context of the method according to the first object can be applied mutatis mutandis to the apparatus according to the second object.

The alignment data can be used to assess/control loads on any component of the dragline or electric shovel, e.g. the boom 4, the mast 14, stays 16, drag and hoist ropes 8, 18, bucket 8, fixtures, mounts, the platform, axles, etc.

DETAILED DESCRIPTION OF PREFERRED EMBODIMENTS

Figure 4:
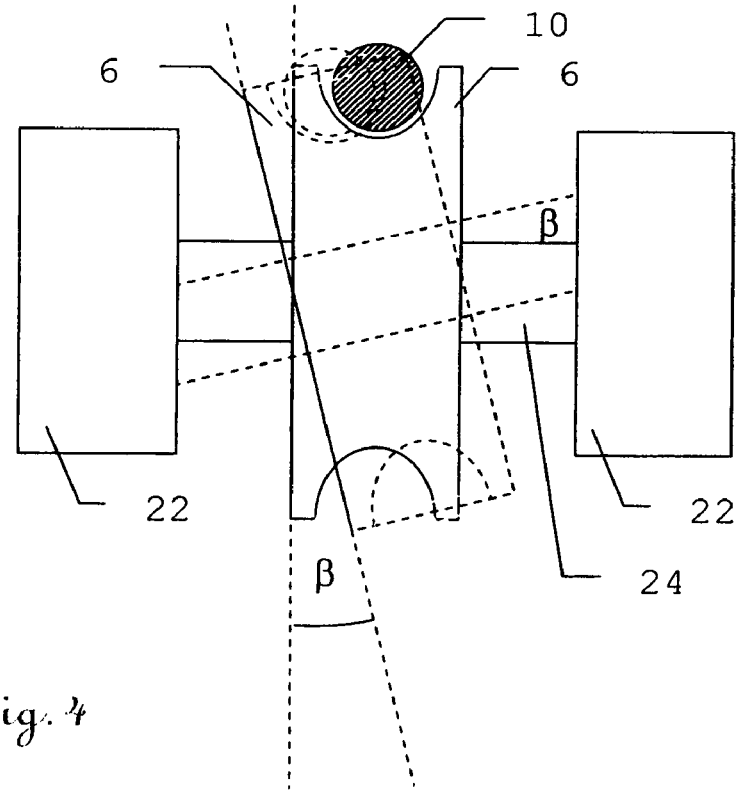
Figure 5:
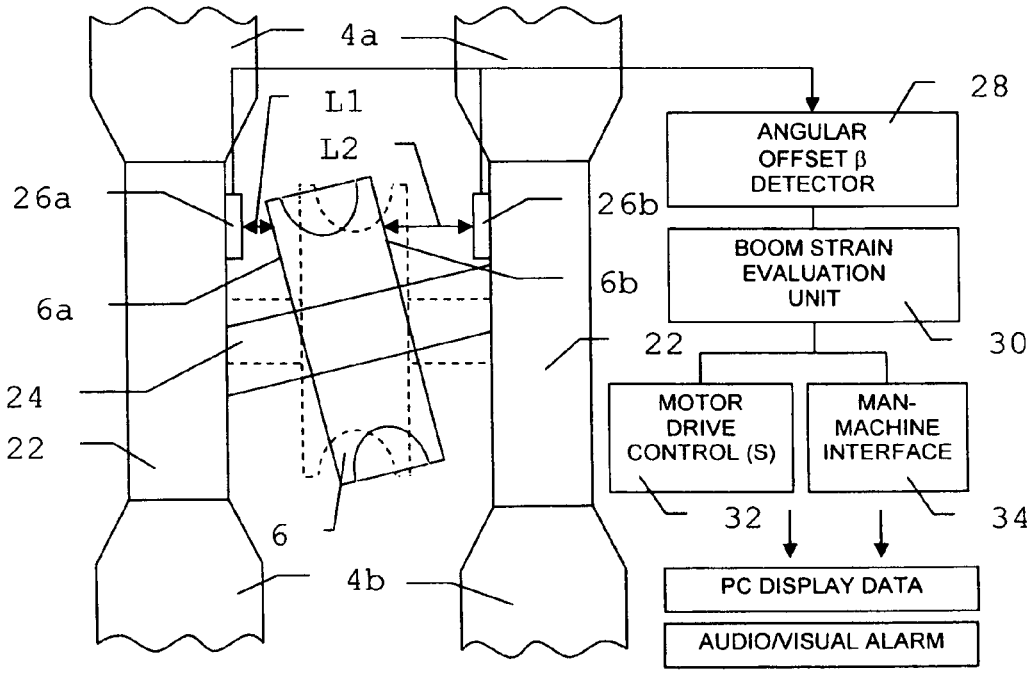
Figure 6:
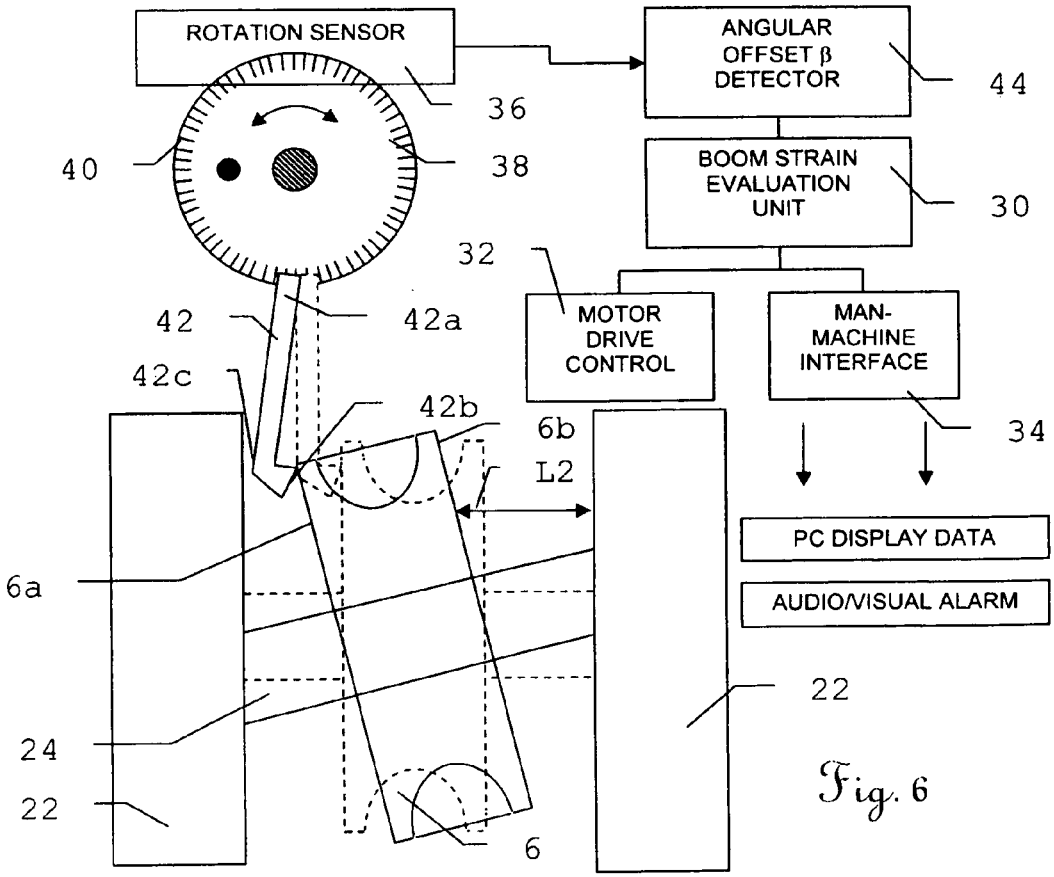
Figure 7:
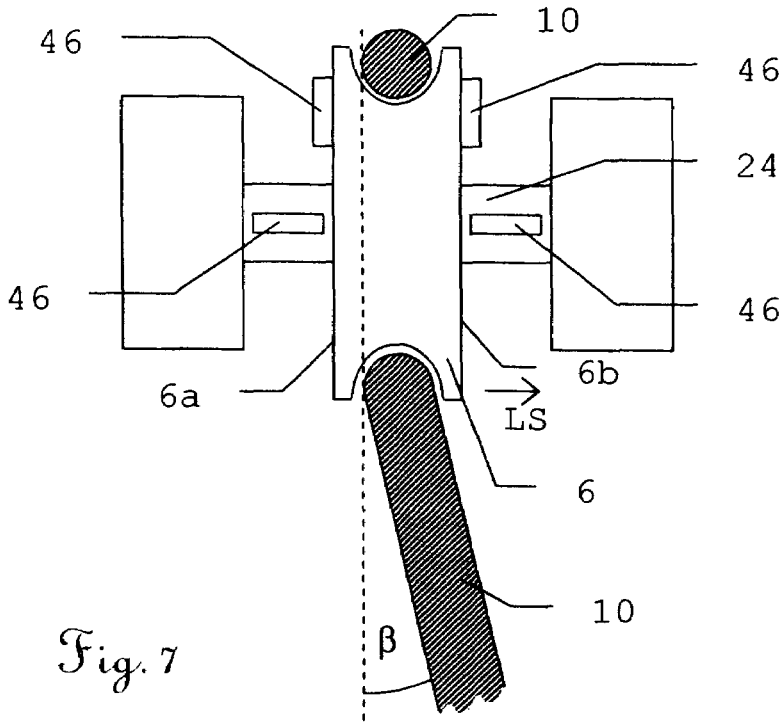
Figure 8:
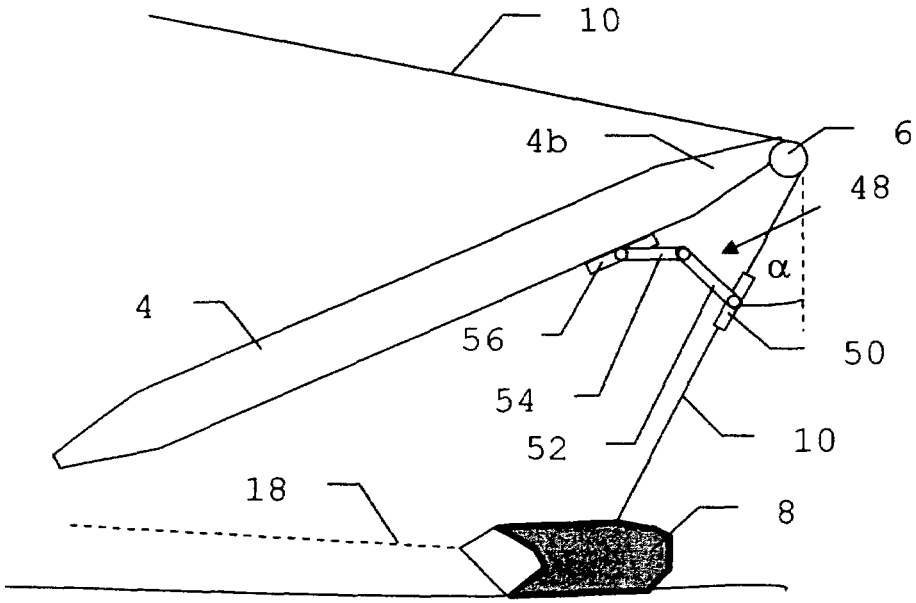
Figure 9:
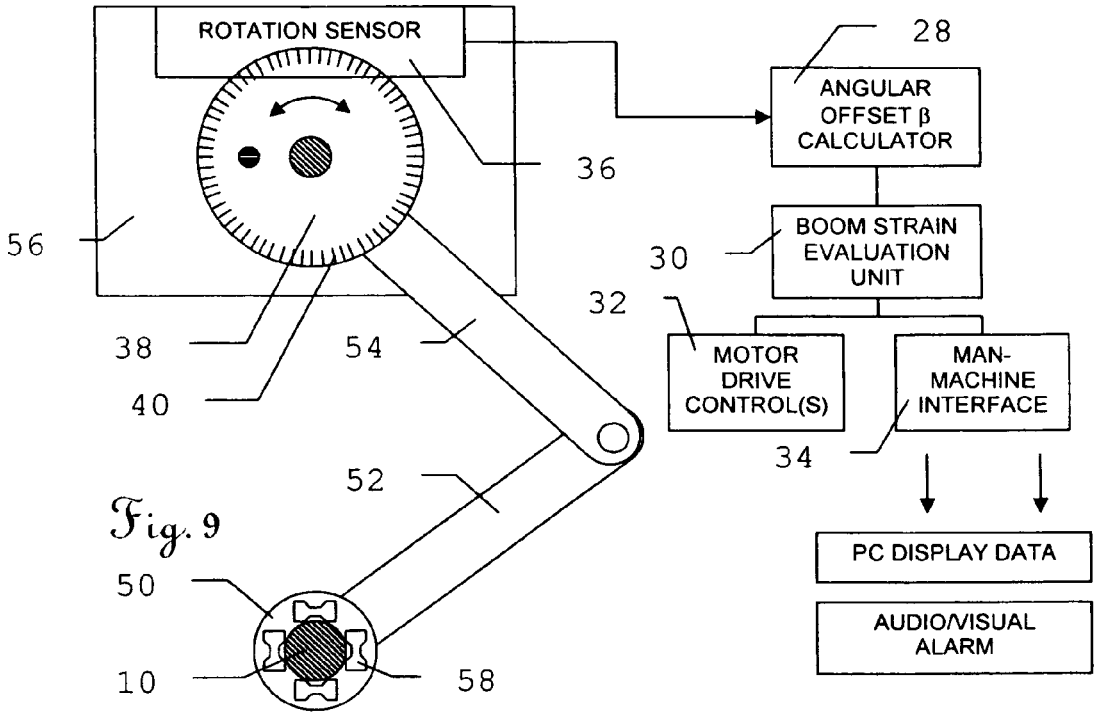
Figure 10:
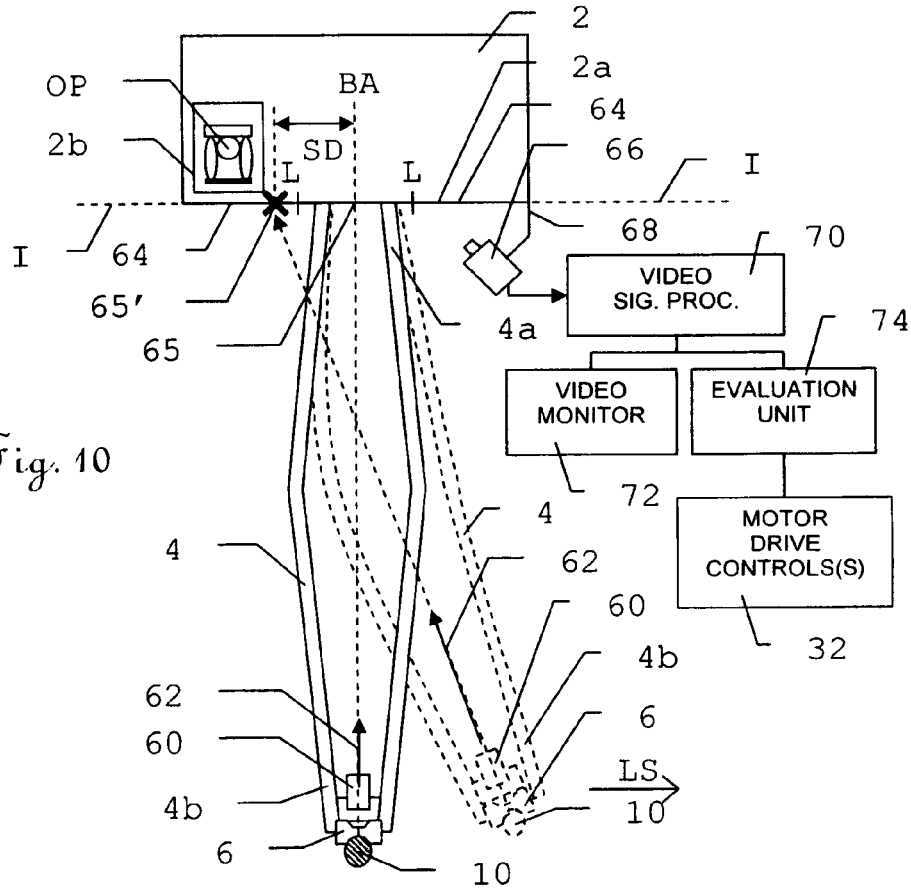
Figure 13:
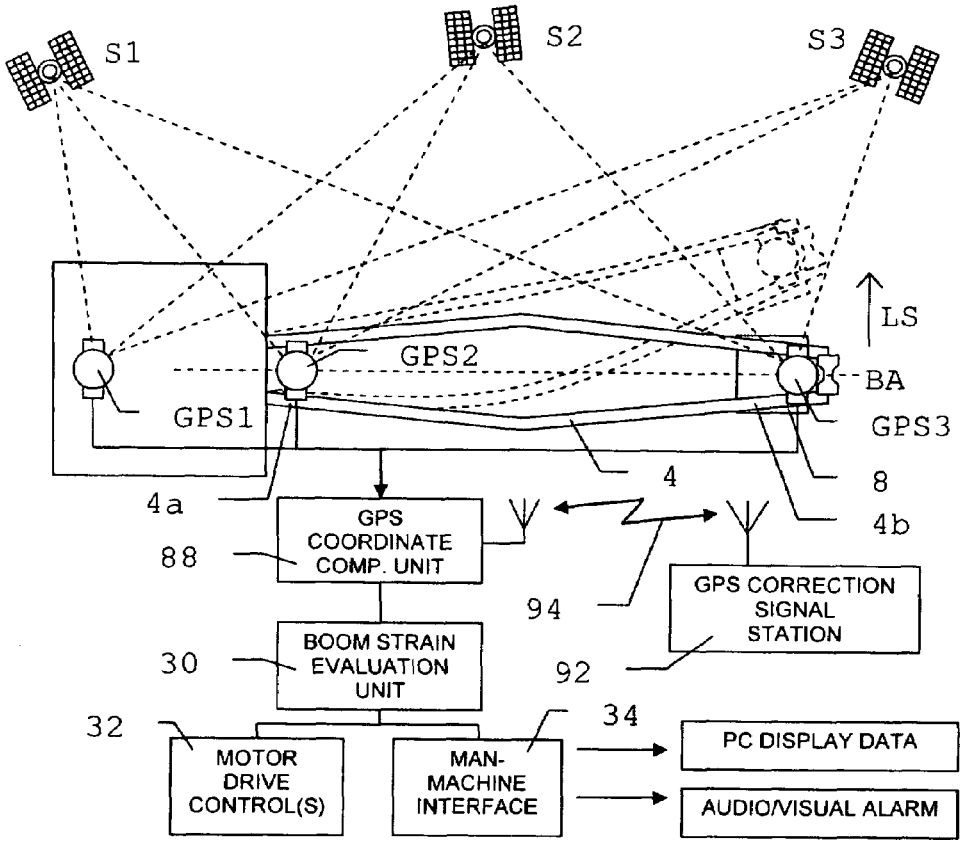
Figure 14:
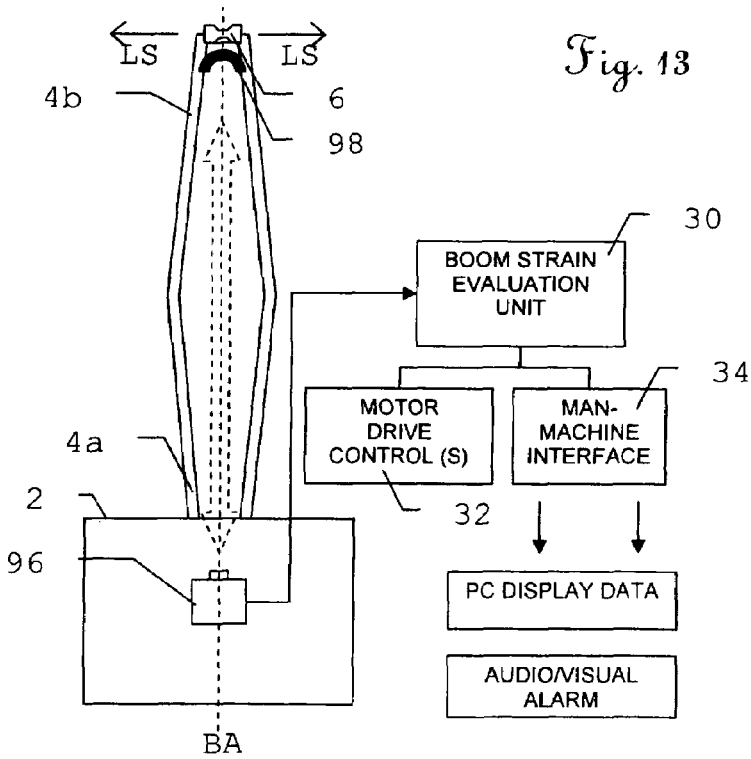
Figure 15:
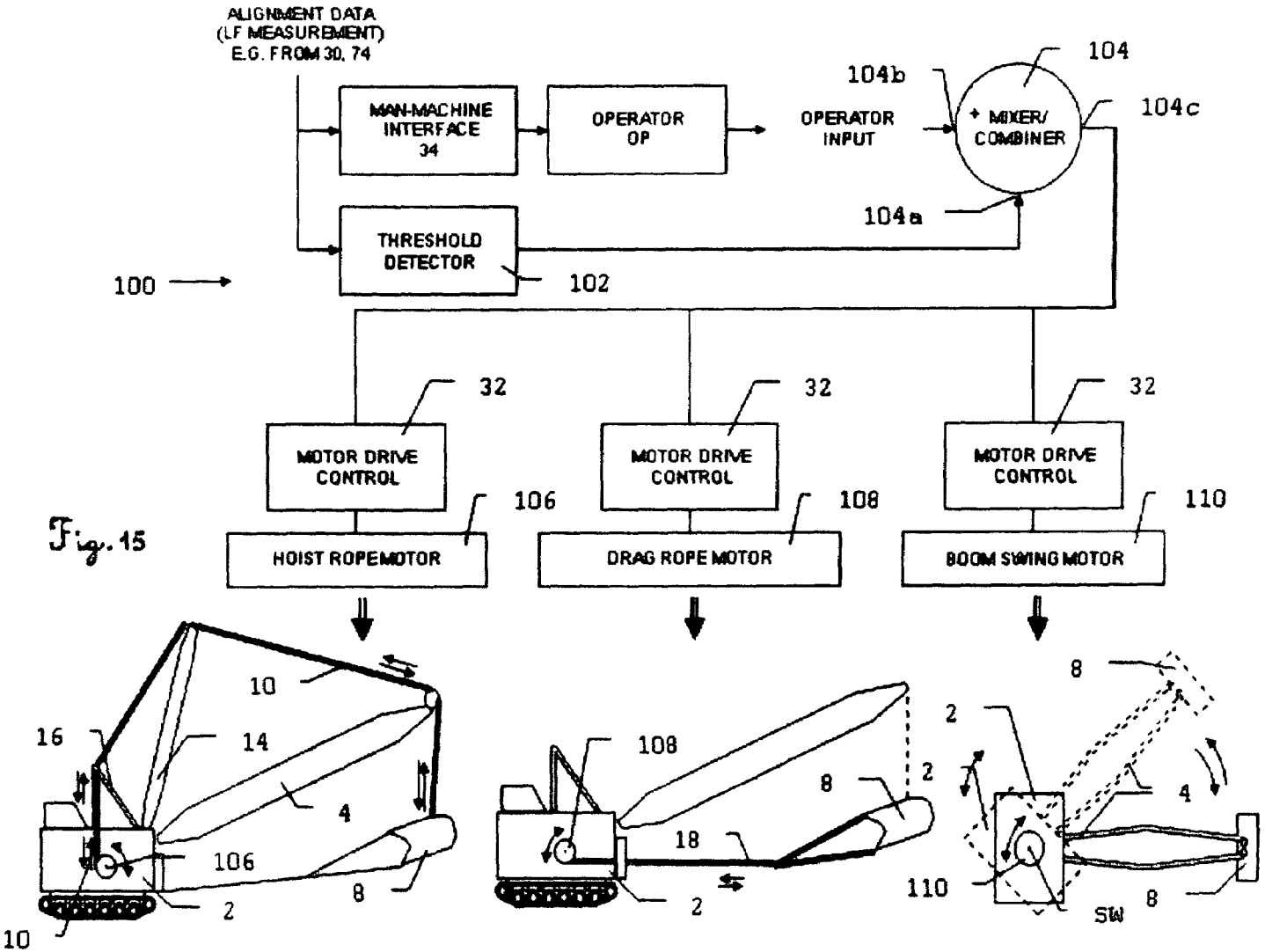

The invention and its advantages shall be better understood from reading the following description of the preferred embodiments, given purely as non-limiting examples, with reference to the appended drawings in which:

FIG. 1, already described, is a simplified diagram of a dragline,

FIG. 2, already described, is a simplified diagram showing the correct, on-axis, alignment of the bucket with respect to the boom axis, FIG. 3*a*, already described, is a simplified diagram showing a situation in which the bucket is misaligned with respect to the boom axis, during a dragging phase, FIG. 3*b*, already described, is a simplified diagram showing a situation in which the bucket is misaligned with respect to the boom axis, during a bucket hoisting phase, FIG. 3*c*, already described, is a simplified diagram showing a situation in which the bucket is misaligned with respect to the boom axis, during a boom swinging phase, FIG. 4 is a schematic front view of a pulley mechanism at the distal end of the boom, having a pulley axle adapted to tilt to accommodate for a swaying motion, FIG. 5 is a schematic front view of the pulley mechanism of FIG. 4 equipped with non-contacting sensing devices to measure the amount of sway, i.e. tilt in the pulley axle, and functional units to exploit that data, in accordance with a first embodiment of the invention, FIG. 6 is a schematic front view of the pulley mechanism of FIG. 4 equipped with contacting sensing devices associated with a rotation sensor to measure the amount of sway (tilt) in the pulley axle, and functional units to exploit that data, in accordance with a first variant of the first embodiment, FIG. 7 is a schematic front view of a pulley with a fixed (non-swaying) axle at the distal end of the boom, and strain gauges applied at different points of the pulley and axle to determine a lateral stress in accordance with a second embodiment, FIG. 8 is a schematic side view showing the distal end of the boom and the hoist rope, equipped with an angular rotation sensor device mechanically coupled to the hoist rope, in accordance with a third embodiment of the invention, FIG. 9 is a schematic plan view of the mechanical sensor arrangement of FIG. 8, also showing associated functional units exploiting the sensor signals, FIG. 10, is a schematic plan view of a dragline equipped with a laser and camera means for detecting a lateral boom deflection, in accordance with a fourth embodiment of the invention, FIG. 11, is a schematic front view of the dragline equipped with a video camera arranged to image the hoist rope, in accordance with a fifth embodiment of the invention, FIG. 12*a* is a schematic side view of a dragline illustrating a variant of the fifth embodiment in which a camera is arranged to image with a plunging view, FIG. 12*b* is a schematic front view of the dragline in accordance with the first variant of FIG. 12*a*, also showing the imaged scene from the camera, FIG. 13 is a schematic plan view of a dragline equipped with GPS receivers for detecting a lateral boom deflection, in accordance with a sixth embodiment of the invention, FIG. 14 is a schematic plan view of a dragline equipped with a surveying device and target respectively on the base unit and distal end of the boom, for detecting a lateral deflection of the boom, in accordance with a seventh embodiment of the invention, and FIG. 15 is a simplified block diagram showing the principle of a feedback control of a motor drive for the hoist rope and/or drag rope, and/or boom swing, based on the alignment information acquired in accordance with the invention, and applicable to any of the embodiments.

The description of the preferred embodiments is based on the dragline already described with reference to FIGS. 1 to 3 inclusive. These figures and their description are not repeated for the sake of conciseness. The teachings can be transposed to an electric shovel.

In what follows, the terms lateral misalignment (or more succinctly misalignment), or angle of misalignment, are referenced with respect to the plane containing the axis BA of the boom 4 in its normal, straight (undeflected) condition. Unless otherwise stated, the boom axis BA refers to the theoretical axis with no lateral distortion.

For the hoist rope 10, the lateral misalignment is assessed as an angle β on a vertical plane, transverse to the boom axis BA, subtended by the hoist rope with respect to the vertical.

For the drag rope 18, the lateral misalignment is assessed as an angle on a horizontal plane, subtended by the drag rope with the projection of the boom axis BA on that horizontal plane.

For the boom itself, the lateral misalignment expresses a distortion of the boom in a lateral direction, causing the distal end 4*b* of the boom to be laterally displaced in a horizontal plane with respect to its alignment along the (normal) boom axis BA.

The following embodiments of the invention describe a number of different means for detecting one or more among the following conditions:

i) a lateral flexing of the boom 4, ii) a line, or lines, of force having at least a component causing a lateral stress LS on the boom, iii) a lateral misalignment of the hoist rope 10, bucket 8 or of the drag rope 18 with respect to the boom axis BA.

These means can be mechanical, and/or optical/electrooptical, and/or radiofrequency, and/or other.

The information is used for assessing and controlling the load conditions on the boom 4, and/or any other component of the dragline, such as the mast 14, stays 16, elevated structure 12 components, anchoring points, linkages, the mounting platform, bearings, fixtures, etc.

First are described embodiments which use the pulley 6 suspending the hoist rope 10 at the distal end 4*b* of the boom 4 as the means for detecting a lateral stress/lateral misalignment of the hoist rope.

FIG. 4 illustrates a type of pulley mechanism sometimes used in draglines, in which the pulley 6 is mounted on bearings 22 which allow some controlled swaying, i.e. tilting movement of pulley axle 24. In the figure, the pulley axle 24 is also shown in a tilted position (dotted lines) in response to the hoist rope 10 being laterally misaligned. The swaying force is transmitted by the hoist rope pressing on one of the inner sidewalls of the pulley's guiding groove. Assuming that the general plane of the pulley 6 sways to follow exactly the angle of the hoist rope's misalignment, the corresponding angular offset β of the pulley axle 24 when thus tilted is equal to the angle of the rope's misalignment.

FIG. 5 shows a first embodiment based on the pulley mechanism of FIG. 4, in which the swaying motion of the pulley and pulley axle is determined by distance measuring sensors. In the example, two distance measuring sensors 26*a* and 26*b* are provided on the surface portions of the bearing casing that confront respective outer side faces 6*a*, 6*b* of the pulley. The sensors 26*a*, 26*b* are arranged to measure the distance, respectively L1 and L2, from their location to a respective outer side face 6*a*, 6*b* of the pulley, this distance being measured along a direction parallel to the unswayed pulley axle 24, i.e. perpendicular to the pulley outer side faces when unswayed. The sensors 26*a*, 26*b* can be of any known suitable technology, e.g. optical (such as laser based) or acoustic, comprising an optical/acoustic source and a sensor analysing the returned laser/acoustic signal to derive the distance measurements S1, S2.

The sensors 26*a* and 26*b* are mounted symmetrically such that when the hoist rope 10 is aligned with the boom axis, the distances L1 and L2 measured by the sensors 26*a* and 26*b* are the same. Differences between the distances L1 and L2 measured by the sensors therefore express the angle of inclination (swaying) of the pulley 6, which itself corresponds substantially to the angle of misalignment β of the hoist rope. The values of L1 and L2 are supplied to an angular offset calculator 28, which calculates values of the angle β from the relative values of L1 and L2. The output of this calculator 28 is supplied to a boom strain evaluation unit 30, which is programmed to output a boom strain value in response to the angle β, e.g. from a mathematical model or look-up tables, taking into account the forces exerted on the hoist and drag ropes. The boom strain value is then supplied to the controller(s) 32 for the drive motor(s) of one or several of the different motor drives of the dragline. The latter can be the motor drive for hoist rope 10, the motor drive for the drag rope 18 and the motor drive for the boom swing. In this way, the motor drive(s) can perform a real-time feedback control of the dragline operating parameters to keep the boom stress under proper control, and optionally record the load values for servicing purposes. The controller(s) can be programmed to allow controlled overloads (beyond manufacturer's prescribed limits) of the dragline structure for maximum work output, while remaining below the thresholds of structural damage. The overload can e.g. be controlled to be temporary. The allowed degree of overload can also take into account such factors as: whether the dragline is in a dragging, hoisting or boom swing phase, rope tension values, the elevation angle of the boom, oscillations in the rope or boom, wind speed, state of the boom (e.g. whether repaired) etc. The drive can be controlled in real time in response to the alignment/misalignment information to adapt the drive speed or acceleration accordingly, notably by a reduction in acceleration or speed as a function of load/overload, or to stop the drive.

It will be appreciated that the controller(s) 32 can also be suitably programmed to control the motor drive directly in response to the values L1 and L2, i.e. without recourse to the angular offset calculator 28 and/or boom strain evaluation unit 30. In the example, the output of the boom strain evaluation unit 30 is also sent to a man-machine interface 34. The latter is a personal computer type of apparatus with a data display screen placed on board the operator's cabin 2*b*. The computer comprises software and firmware modules arranged to process the output from the boom strain evaluation unit 30 and produce in real time, in response, a synthesised diagram of the boom and with a representation of its distortion along a reference scale, possibly with other data, such as the estimated stress, load on the ropes, position of the bucket, duration of the lateral stress, suggested actions, etc. In addition, or alternatively, the data can sent to an audio and/or visible alarm, alerting the operator of a lateral stress beyond a determined threshold.

FIG. 6 shows a first variant of the first embodiment, also based on the pulley mechanism of FIG. 4, in which the swaying motion of the pulley 6 is measured by a rotation sensor 36 having a rotary disk 38. The disk is provided with encoded indicia 40 readable by an optical sensor of the rotation sensor 36. The optical sensor can be implemented using a CCD or an LED, according to known technology. The rotation sensor 36 delivers a signal indicating the instant angular position of a reference point on the disk 38. That point can be set to coincide with the angular position of the assembly 52, 54 when the hoist rope 10 when it is aligned with the boom axis BA.

The rotary disk 38 of the sensor is joined to the proximal end 42*a* of rigid stem 42, whose distal end 42*b* is arranged to be resiliently biased firmly against the outer face of a flange 6*a* of the pulley 6 to follow its lateral displacement. The distal end 42*b* contacts the pulley near the circumference and at a point vertically above or below the pulley axle 24 for maximum translational movement for a given angle of tilt, i.e. sway. Accordingly, the stem 42 causes the rotary disk 38 to turn as a function of pulley's swaying motion from its central position (the latter is illustrated in dotted lines). The rotation signal from the sensor 36 is sent to an angular offset angle detector 44, similar to offset calculator 28, calibrated to produce an indication of the misalignment angle β in response to the evolution of rotation sensor output as the pulley tilts.

Preferably, a concentric groove (not shown) is provided on the side face 6*a* of the pulley to receive and guide the distal end 42*b* of the stem, allowing it to maintain a fixed radial position with respect to the pulley's axle 24, while allowing the pulley to rotate freely.

In the example, stem is generally straight up to the distal end 42*b*, at the region of which it has a bend portion 42*c* to place the contact point with the pulley entering from the side. The proximal end 42*a* of the stem is laterally displaced from the pulley. This configuration of the stem and its positioning allows to follow the swaying motion of the pulley without interfering with the passage of the rope 10.

Alternatively, the stem 42 can be made to divide into two branches at the distal end, forming a fork embracing the pulley with sufficient free space around the sides to accommodate for its tilting motion as it sways. The free ends of the fork are turned inwardly to contact a respective outer face of the pulley flanges 6*a* and 6*b*, again preferable near their circumference and above or below the pulley axle to convert the pulley's swaying or swinging motion into a substantial angular displacement of the stem.

Depending on the dragline, the response of the pulley bearing 22, and its operating conditions, the angle of deflection determined by the rotation sensor 36 may not correspond to the actual misalignment angle β of the rope. In this case, an experimentally-determined scaling or correction factor may be used in the angular offset detector 44.

Likewise, a similar correction factor can be applied in the embodiment of FIG. 5 if the swaying angle of the tilted pulley does not properly match the hoist rope's angle of misalignment.

In a further a variant, the rotary sensor and stem can be replaced by a feeler device, such as a spring loaded plunger projecting inwardly from the bearing housing and impinging one of the faces 6*a* or 6*b* of the pulley. Each plunger is associated to a sensor measuring its projection, corresponding to the distance L1 or L2 (cf. FIG. 4) to determine the amount of sway in the pulley, based on the known value of L1 when there is no sway in the pulley. This variant can also be implemented with two feeler devices operating on opposite side faces 6*a* and 6*b* of the pulley, in a manner analogous to the embodiment of FIG. 5, so delivering the two distance values L1 and L2.

Conversely, the embodiment of FIG. 5 could be implemented with just one sensor device 26*a* or 26*b* laser beam, using the fact that the value of L1/L2 or L2/L1 when the pulley is unswayed (not deflected) is a known constant.

In a second embodiment, the pulley mechanism can also be used as a point of measurement of lateral stress on the boom 4 even if it not designed to allow the above-described swaying motion of the pulley 6 and axle 24. In this case, the measurement can be effected by means of one or several strain gauges, as illustrated in FIG. 7.

As shown in the example of FIG. 7, strain gauges 46 can be placed on the outer side faces of the flanges 6*a*, 6*b* of the pulley 6 and/or on the pulley axle 24. The gauges are connected to a calculation unit (not shown) where the detected distortion is converted to a lateral stress LS value on the boom. This conversion can be established on the basis of prestored conversion tables obtained empirically from test data, or from mathematical modelling.

FIG. 8 illustrates schematically a third embodiment of the invention, in which the alignment/misalignment of the drag rope 10 is also detected by mechanical means 48. These comprise a short sleeve 50, or alternatively a ring, surrounding the drag rope 10, and by which lateral deflections of the rope are detected by angle sensors. The sleeve 50 is connected to the underside of the boom 4 by a mechanical assembly comprising two arms 52, 54 which are mutually articulated to allow the sleeve 50 to follow the variations of the rope angle $\alpha$ in the vertical longitudinal plane as the bucket 8 is dragged (cf. FIG. 1). The lengths of the arms 52, 54 are set to allow the sleeve 50 to follow the full amplitude of the evolutions of the angle $\alpha$ of the hoist rope 10, without impeding the movement of the latter. The arm assembly 52, 54 is rigid in the lateral direction, i.e. in the direction of lateral stress LS, and joins to a rotary sensor within a housing 56 fixed to the boom 4.

As shown in FIG. 9, arm 54 of the assembly is attached to a rotary sensor disk 38 comprising encoded indicia 40 readable by an optical sensor device 36, analogous to the sensor 36 of FIG. 6, and which can also be implemented using a CCD or a LED, according to known technology. The sensor 36 delivers a signal indicating the instant angular position of a reference point on the disk. That point can be set to coincide with the angular position of the assembly 52, 54 when the hoist rope 10 is aligned with the boom axis BA. The output from the sensor is pre-processed by an angular offset calculator 28, which produces the value of the deflection angle $\beta$ of the rope as the disk 38 is caused to rotate by the arm assembly 52, 54.

The calculator 28 is similar to the one of FIG. 4 used to express the rope angle $\beta$. This angle value is inputted to a boom strain evaluation unit 30 which is also fed with the values of the loads on the ropes 10 and 18 to produce monitoring and alarm information to a man-machine interface 34. The latter is substantially the same as in the first embodiment, producing equivalent PC display data and audio/visual alarms signals as described above. The boom strain evaluation unit 30 also delivers signals to one or several motor drive controls 32 for real time automated control of the dragline load parameters, as described above, notably allowing a controlled overload.

To minimise interference with the natural movement of the rope 10, the inside of the sleeve 50 is equipped with a set of four rollers 58 whose axes are along respective sides of a square. The rollers surround the rope 10, and each one has a concave profile to follow its contour.

In variants of this second embodiment, the rotation angle sensor can be replaced by a linear displacement sensor, with appropriate adaptation of the linkages to the hoist rope 10, or drag rope 18.

FIG. 10 illustrates a fourth embodiment of the invention based on an optical laser 60 fixedly mounted on the distal end 4*b* of the boom, shown here in a plan view. The laser 60 is powered to generate a laser beam 62 which impinges on a target zone 64 provided on the front face 2*a* (line I-I) of the base unit 2, where it creates a detectable beam spot 65. The laser is positionally referenced so that its beam 62 is aligned to follow the boom axis BA when the boom is in its normal state, with no lateral distortion. The beam spot 65 in this case impinges at a point along a vertical line where the proximal end 4*a* of the boom is centred. The vertical position of the spot depends on the inclination of the boom. Its lateral position along the target zone 64 depends on a lateral distortion of the boom 4: as the boom experiences a lateral stress, its distal end 4*b* is deflected in the direction of stress, and the laser 60 fixed at that point is no longer directing the beam spot 65' on the vertical centerline, as shown in dotted lines. The displacement SD of the beam spot 65' from the vertical centerline expresses the amount of lateral distortion, and provides a sensitive measurement of that parameter by the virtue of the considerable optical lever effect.

The target zone 64 is monitored by a video camera 66 mounted on the base unit 2 by means of a forwardly projecting bracket 68. The raw signal from the camera is supplied to a video signal processor unit 70 which emphasises the image of the beam spot 65, 65'. The output from the processor unit 70 is supplied for display on a monitor 72 located at the dragline's control cabin 2*b*, where it acts as a man-machine interface for monitoring the lateral stress LS on the boom 4. The monitor 72, also referred to as video monitor, can be a computer monitor connected to a PC type computer. In this way, it is amenable to display computer generated data. The information can be complemented by markings delimiting limits L on either side of the vertical centerline, beyond which the flexing of the boom has attained a danger threshold. These markings can be painted on the part of the front 2*a* of the base unit that serves as the target zone 64, or inserted electronically by the video signal processor 70. Other markings can be provided in the same way to indicate e.g. graduations of lateral deflection SD, possibly in units expressing force or percentages of the safe working limit. The contents of the display thus comprise the above reference markings and a real-time representation of the beam spot 65, 65'.

In this way, the operator OP observing the video monitor 72 can use this technical information to monitor the lateral distortion of the boom at any time and derive a warning of damaging lateral stresses on the boom.

The output of video signal processor 70 is also applied to a computerised evaluation unit 74 programmed to detect automatically the position of the beam spot 65, 65' and react accordingly. The reaction can be a warning signal detectable by the human operator OP, or a command to one or several of the motor drive controls 32 already described, e.g. to reduce or halt the application of the towing force TF on the drag rope 18 and/or the force SF on the hoist rope 10, or again the swinging motion of the boom 4.

The evolution of the lateral position of the beam spot can thus be exploited in an automated or human feedback control of the dragline's operating conditions, notably of the load applied to the drag rope and/or the hoist rope, boom swing, as explained above.

FIG. 11 illustrates a fifth embodiment of the invention, also based on optical means, which in this case serve to monitor the alignment of the hoist rope 10 and bucket 8. The monitoring is obtained by a video camera 76 mounted on the boom 4, with the lens directed to image the hoist rope 10 suspended from the pulley 6. The camera's field of view is adjusted against a graticule 78 which serves as a reference for assessing the rope's lateral alignment/misalignment. The graticule can be physical markings 78*a* on a transparent plate in front of the camera lens, or it can be inserted electronically. In the example, the graticule is designed to show a vertical centerline against which the image 10I of the hoist rope 10 coincides when in correct lateral alignment, and a set of inclined lines converging towards the top, associated with indicia 78*b* to enable the operator OP to assess the degree of rope lateral misalignment.

The video output of the camera 76 is sent to a video signal processor 70', similar to processor 70 described above, but optimised to enhance the visibility of the rope's image 10I and to insert the graticule 78 when it is created electronically. The output of the video signal processor 70' is sent to a video monitor 72 at the operator's cabin 2*b*, as in the previous embodiment, where it displays for the operator OP the rope's image 10I and graticule 78 (box 79). In this way, the video monitor also provides a man-machine interface producing technical information so as to enable the operator to assess the rope's lateral alignment/misalignment. The video monitor 72 can be the computer monitor associated to a PC as described with reference to the previous embodiments, or simply a TV monitor.

The video signal processor 70' also extracts and exploits the pixels of the rope's image 10I to derive computer exploitable data on the rope's lateral inclination angle β. This data is supplied to an evaluation unit 74', similar to evaluation unit 74 described above, adapted to use that inclination angle data in conjunction with the instantaneous load values applied on the drag ropes 10, 18, supplied as input parameters. In this way, it determines the lateral stress LS on the boom 4 and acts on the motor drive control(s) 32 as described above to adjust in real time the load on the ropes 10, 18 and if needs be the boom swing dynamics accordingly.

Likewise, the operator OP can exploit the rope inclination data with his knowledge of the instantaneous loads applied to the ropes to assess the risk of boom damage. As in the previous embodiment, the information from the video signal processor 70' or evaluation unit 74' can also be used to trigger an alarm signal detectable by the operator when a certain risk level is detected or to influence the respective drive motors. In certain cases it may be beneficial to only show the derived load characteristics data to the operator.

The camera 76 can be placed at any suitable point along the length of the boom, based on the following considerations: the closer it is to the pulley 6, the closer it will be to the rope 10, and hence the better the viewing position, while the further it is from the pulley, the greater the absolute lateral displacement of the rope for a given misalignment—and hence the easier to detect that misalignment.

In a variant, a camera 80 can be arranged to view the bucket 8 instead of the rope 10, for instance by being placed at the front face 2*a* of the base unit, at a position in vertical alignment with the proximal end 4*a* of the boom 4. The video signal processor 70' is then optimised to analyse the contours of the imaged bucket and thereby determine the lateral position of its centerline. This variant has the advantage of placing the camera 80 at a zone that is relatively more sheltered and stabilised, and of using a larger object (bucket) as the imaging target, compensating for the additional viewing distance.

Naturally, it is possible to implement both cameras 76 and 80, and possibly others, so as to provide the operator OP/evaluation unit with multiple image data for analysing the operating conditions.

FIGS. 12*a* and 12*b* illustrate another variant in which a video camera 82 is arranged to provide a plunging view of drag rope 10. In the example, the camera 82 is mounted on a bracket 84 projecting from the distal end 4*b* of the boom 4. The camera 82 is located forward of the vertical from the pulley 6 and turned at an angle towards the ground zone where the bucket 8 operates, so as to provide a field of view as shown by the broken lines FOV. The field of view covers both the hoist rope 10 (foreground) and the drag rope 18 (background), as well as the bucket 8. The vertical centerline of the camera image 86 coincides with the vertical projection of the boom axis BA when the boom is not deformed, and hence also with the lateral alignment of the drag rope 18 and hoist rope 10 under correct working conditions (FIG. 12*b*). As shown more particularly in FIG. 12*b*, the camera 86 can thereby detect a lateral misalignment of the hoist rope 10, drag rope 18 and bucket 8 (representation in dotted lines). As in the other embodiments, the signal from the camera 82 is processed as already described with reference to FIG. 11 to produce the image 86 on the operator's video monitor 72 and/or for exploitation by an evaluation unit 74' controlling the motor drive control(s) in the manner described above.

The camera arrangement of FIGS. 12*a* and 12*b* can be implemented in addition to the camera arrangements described with reference to FIG. 11, providing a further source of visual monitoring information and/or computer data on the alignment conditions.

FIG. 13 illustrates a sixth embodiment based on GPS receivers to detect a lateral distortion of the boom 4 arising from a lateral stress LS. In the example, three GPS receivers GPS1, GPS2 and GPS3 are positioned along the longitudinal axis of the dragline containing the boom axis BA. A first GPS receiver GPS1 is fixed onto base unit 2 of the dragline, for which it constitutes a fixed reference point. The other two receivers, GPS2 and GPS3, are fixed respectively at the proximal and distal ends 4*a* and 4*b* of the boom 4.

The three GPS receivers obtain their coordinate position data from satellites S1, S2, S3, . . . at frequent intervals, say every second. They send these coordinate position data by wire or wireless link to a GPS coordinate comparison unit 88, where they are analysed. The GPS coordinate comparison unit initially stores the coordinate position data of the three GPS receivers corresponding to the current location of the dragline and in a condition where the boom is not submitted to a lateral stress. The coordinate data from receivers GPS1 and GPS2, respectively at the base unit 2 and at the proximal end 4*a* of the boom, serve to determine the theoretical orientation of the boom with respect to a fixed coordinate system as the boom axis BA swings (axis SW, FIG. 1). From the coordinate data of receivers GPS1 and GPS2, the comparison unit 88 can thus determine by extrapolation the three-dimensional coordinates of any point lying on the boom axis BA, under a condition of zero lateral stress (theoretical boom axis), and conversely can verify whether a given three-dimensional coordinate lies on that axis or not.

In this way, it verifies whether or not the coordinate data from third receiver GPS3, at the distal end 4*b*, lies on the theoretical boom axis BA. More particularly, it assesses, by standard transformation techniques, the amount lateral deflection of the distal end 4*b* of the boom from the theoretical boom axis BA, resulting from a lateral stress LS. By a similar technique, it can also measure, if needs be, a sag of the boom in the vertical plane.

The calculated value of the lateral deflection of the boom is supplied to a boom strain evaluation unit 30 as described above, which determines the response to take as a function of the amount of estimated lateral stress, based on the deflection data, as well as possibly other parameters, such as the load on the ropes 10, 18, motor drive parameters, etc.

The response takes the form of a signal or data sent in adapted form to a man-machine interface 34 of the type described above.

The boom strain evaluation unit 30 can also be adapted to supply signals to a feedback loop with the motor drive control(s) 32 for the hoist rope, drag rope or boom swing drive(s), as already described.

For enhanced accuracy of the GPS coordinate data, the GPS coordinate comparison unit 88 may be connected to a nearby land-based GPS correction signal station 92, if available, e.g. by a radio link 94.

Another approach uses 3 GPS units distributed on the boom, e.g. one at its proximal end, one in the middle, one at its distal end, to assess the boom curvature as a consequence of lateral load forces.

FIG. 14 illustrates a seventh embodiment of the invention in which a lateral deflection of the boom 4 resulting from lateral stress LS is detected by surveying techniques. The concept uses a surveying device located at a fixed position with respect to the base unit 2 or the proximal end 4*a*, adapted to monitor the azimuthal angle of the distal end 4*b* relative a reference axis, suitably the undeflected boom axis BA.

In the example, this technique is implemented by an auto-tracking total station 96 fixed on the base unit 2 and positioned in alignment with the boom axis BA. The total station 96 is trained on a target 98, such as an optical prism or mirror, used in surveying. The auto-tracking function of the total station 96 allows the latter to follow automatically the movements of the distal end 4*b* of the boom and to provide continuous information on the evolution of its azimuthal angle, which is normalized to the deflection angle of boom. The deflection angle data is processed by a boom strain evaluation unit 30, analogous to the one described e.g. with reference to FIG. 5, and which sends signals to the motor drive control(s) 32 and/or to a man-machine interface 34 as explained above.

Further embodiments of the invention can be implemented by monitoring the torque on the shaft of the swing axis SW of the boom structure (cf. FIG. 1). In this case, a feedback monitor circuit can be placed in the swing motor drive used for swinging the boom structure. The monitor circuit can determine the turning moment on the swing axis SW, e.g. when the bucket 8 is being dragged, that turning moment resulting from a misalignment of the suspending and drag ropes 8 and 18. The turning moment can be evaluated by various techniques, e.g. by measuring the torque to be applied by the drive motor to compensate for that moment.

FIG. 15 illustrates schematically a real-time feedback control system 100 suitable for the motor drive of any one of the hoist rope drive, drag rope drive, or boom swing drive. This feedback control system, typically in the form of a servo system, can be applied to any of the embodiments having been described. It may, for instance, be functionally integrated with the evaluation unit 74 or motor drive control 32.

The system takes as input the alignment data acquired concerning the alignment/misalignment of the boom structure 4, hoist rope 10, drag rope 18 or bucket 8, which is assimilated to a low frequency measurement. Typically, that data is delivered in adapted form by the boom strain evaluation unit 30, or the evaluation unit 74, 38', or the like. The values of the parameters evaluated, which are indicative of lateral boom stress or a risk of lateral boom stress, are submitted to a threshold detector 102, which assesses whether one or several graded stress limit values are reached. The output of the threshold detector is applied to a first mixing input 104*a* of a signal mixer or combiner 104 having a second input 104*b* for accepting command drive signals from the operator OP. The operator acts through a command interface taking into account the alignment data produced on his man-machine interface 34.

The output of mixer/combiner 104 produces the motor drive commands. In this example, the command is a weighted or equal combination of inputs from both the operator and an automated analysis of the alignment conditions. The system can thus allow a manual override to a certain degree, or e.g. produce automatically an operational stress limit envelope within which the operator is free to fix the values. In variants, the mixer 104 can be omitted, whereby the control is entirely manual, based on the operator's information produced on the man-machine interface indicating the acquired alignment/misalignment conditions, or alternatively entirely automated. In the latter case, the alignment data is sent directly to the motor drive(s) 32, if needs be via the threshold detector 32. The latter can be omitted in variant embodiments.

The control means 100 is in a feedback loop, with the detection of the alignment/misalignment condition feeding back information in real time to implement the control performed by the motor drive command. The alignment/misalignment data can be sampled at a suitable frequency to ensure a real-time or quasi real time control of the drive and load conditions.

The implementation of the command system can be based on any suitable servo control loop using standard engineering practice.

The operator and/or automated control may be provided with limit stress values corresponding to maximum boom load limits, typically standard manufacturers limits. This maximum load data can be presented in the form of graphical charts, or indicia on a load indication scale presented on the man-machine interface, or it can be in the form of stored machine readable data in look-up tables or a database.

The experience of the human operator allows him to determine if and when an indicated overload can be tolerated, for instance in certain phases, or for certain periods, taking various parameters into account.

For an automated feedback control of drive motors, the maximum load values can be exploited similarly to command intelligently an overload under specific programmed conditions, taking into account other parameters, e.g. based on fuzzy logic techniques.

In this way, the human operator and/or the automated feedback control can control the operation of the dragline with substantially no excessive stress while being under conditions at—or controllably exceeding—standard manufacturer's limits for the boom and possibly other critical components such as the mast 14, stays 16, ropes 10, 18, bucket 8, platform, anchoring points, etc.

It will be appreciated that the above-described alignment monitoring and human or automated control of the hoist rope and/or drag rope and/or boomswing drive motor(s), as a function of that monitoring, can take place at all times or whenever judged necessary. The above-described monitoring and human or automated control can be carried out notably during:

- a dragging operation for loading the bucket,
- a hoisting operation for raising or lowering the bucket,
- a swinging operation for moving the bucket to a dumping zone,
- any other phase of operation of the dragline.

In the example of FIG. 15, the signals from the mixer/combiner 104 are used to command respective motor drive controls 32 for:

- a hoist rope motor 106, which is provided at the base unit 2 to wind/unwind the hoist rope 10 from the base unit 2. The command can serve here e.g. to establish the appropriate wind/unwind speed, acceleration/deceleration, stoppage of the hoist rope;

a drag rope motor 108, which is provided at the base unit 2 to wind/unwind the drag rope 18 from the base unit 2. The command can serve here e.g. to establish the appropriate wind/unwind speed, acceleration/deceleration, stoppage of the drag rope; and a boom swing motor 110, which is provided at the base unit 2 to swing the boom 4 laterally e.g. to position the bucket 8 from a drag zone to a dumping zone, the swinging being around the swing axis SW at the base unit as shown in FIG. 1. The command can serve here e.g. to establish the appropriate swing speed, acceleration/deceleration, stoppage of the boom 4, in either direction.

It also possible to adapt the above-described embodiments of the invention to analyse the alignment of the drag rope 18 and/or the bucket 8, instead of or in addition to the alignment of the hoist rope 10.

Thus, for the embodiment of FIG. 11, the camera 76, or an additional camera, may also be arranged to monitor the alignment of the drag rope 18, e.g. by being placed at some point along the boom 4 and directed towards the ground, with a field of view covering the zone occupied by the drag rope and bucket. The electronic image can be referenced and processed in the same manner as described for the camera image 46, but to determine the angle subtended by the drag rope 18 with respect to the boom axis BA.

In a similar manner, in the embodiment of FIGS. 12*a* and 12*b*, the camera 50, or an additional camera, may be arranged at some point along the boom and directed to focus more particularly on the alignment of the drag rope 18.

Also, the embodiment of FIG. 9 can be implemented on the drag rope 18 in addition to, or instead of, being implemented on the hoist rope. The sleeve 50 would in that case surround the drag rope 18 at some point between the bucket 8 and the base unit 2, and be coupled to the rotary sensor unit 56 by an adapted arm and bracket device.

The measuring/analysing devices (lasers, cameras, sensors, GPS receivers gauges, etc.) and the functional hardware and software units described in the above embodiments can be powered by any suitable means (power cable, battery pack, solar cells, etc.), and can likewise communicate by any suitable means (wire data link, optical data transmission, radio link, wireless communications protocol (WiFi, Bluetooth, . . . ), etc.).

From the foregoing, it will be understood that the invention can implemented in numerous ways and with numerous techniques, e.g. laser and optical lever, electronic image acquisition, telemetry by radio signals, such as GPS receivers, mechanical sensing on the rope and/or pulley, surveying, etc.

The measurements can be of the actual lateral distortion of the boom, the stresses applied to the boom and their lateral force component, or the angle of misalignment of the hoist and/or drag rope(s) with respect to vertical projection of the boom axis, etc.

It will be apparent that the different embodiments described accommodate for transpositions of means and/or techniques from one embodiment to other. Also, a number different embodiments can be implemented together in a dragline or electric shovel to provide respective complementary sources of alignment data.

Also, the hardware and software aspects of embodiments can be implemented in many different equivalent forms in addition to those described in the examples.

The invention claimed is:

1. Method of monitoring a load condition of a dragline (1) or an electric shovel, the dragline comprising a boom (4), a bucket (8), a hoist rope (10) from which the bucket is suspended from the boom, and a drag rope (18) for dragging the bucket, the boom extending substantially along a boom axis (BA) in its normal, unstressed state, characterised in that it comprises the steps of:

using technical means (26, 28; 42; 46; 48; 60-70; 76, 80; 82; GPS1-GPS3; 96, 98) to produce alignment data indicative of lateral alignment, with respect to a plane containing the boom axis (BA), of at least one of the following dragline components:

i) the hoist rope (10), ii) the drag rope (18), iii) the boom (4), iv) the bucket (8), and determining the lateral alignment.

2. Method according to claim 1, further comprising a step of controlling (32; 34, 72, OP) said load condition of the dragline (1) or electric shovel on the basis of said alignment data.

3. Method according to claim 2, wherein said alignment data is inputted to a man-machine interface (34, 72), e.g. a display device (72), whereby said controlling step is performed via a human operator (OP).

4. Method according to claim 2, wherein said alignment data is inputted to automated control means (32) for controlling at least one of:

i) the drive (106) of the hoist rope (10), ii) the drive (108) of the drag rope (18), iii) the drive (110) of the boom (4), for swinging the boom, to perform said controlling step.

5. Method according to claim 2, wherein the controlling step is performed substantially in real time using a feedback of said alignment data.

6. Method according to claim 2, wherein said controlling step is performed in a combined manner by a human operator (OP) via a man-machine interface (34, 72) and by automated control means (32).

7. Method according to claim 2, wherein said controlling step comprises authorizing a controlled overload of said dragline (1) or electric shovel, notably when controlling a maximum structure stress thereon, as a function of said alignment data.

8. Method according to claim 2, wherein said boom (4) has a specified maximum load limit, and wherein said controlling step comprises authorizing a controlled overload of the boom above said specified load limit as a function of said alignment data.

9. Method according to claim 1, wherein said technical means produce said alignment data as quantitative data indicative of an amount of misalignment in at least one said dragline component (4, 10, 18, 8).

10. Method according to claim 1, wherein said alignment data is obtained by measurement on a pulley (6) along which the hoist rope (10) passes to hang from a distal end (4*b*) of the boom (4).

11. Method according to claim 10, wherein said pulley (6) is configured to sway in response to a lateral stress from the hoist rope (10), and wherein said alignment data is obtained by determining (100*a*, 26*b*, 28; 38-36, 42, 28) the amount of sway of said pulley.

12. Method according to claim 10, wherein said alignment data is obtained by measuring (46) a lateral stress exerted on said pulley (6).

13. Method according to claim 1, wherein said alignment data is obtained by physical contact (46, 48) with at least one said dragline component (4, 8, 10, 18).

14. Method according to claim 13, comprising physically engaging (50) the hoist rope (10) with an angular or linear displacement sensor device (56-36).

15. Method according to claim 1, wherein said alignment data is obtained by detecting a lateral deflection of the boom (4) from said boom axis (BA).

16. Method according to claim 15, wherein said lateral deflection is detected by producing an optical beam (62) from a source (60) attached to the boom (4), preferably at or near a distal end (4*b*), and detecting a displacement (SD) of the beam spot (65') where it impinges a target (64).

17. Method according to claim 1, wherein said alignment data is obtained by imaging (42; 48; 50) at least one said dragline component (4, 8, 10, 18).

18. Method according to claim 17, comprising imaging the hoist rope (10) using camera means (76, 80; 82).

19. Method according to claim 1, wherein said alignment data is obtained by analysing coordinate data from GPS receiver means (GPS1-GPS3), at least one GPS receiver (GPS3) being positioned on said boom (4).

20. Method according to claim 1, wherein said alignment data is obtained by surveying techniques (96, 98), to determine coordinate evolutions of a portion of the boom (4) susceptible of deflecting laterally with respect to its boom axis (BA).

21. Method according to claim 20, comprising surveying a target (98) substantially at the distal end (4*b*) of the boom using a surveying device, preferably a self-tracking total station (96) placed at a known reference point on the dragline.

22. Apparatus for monitoring a load condition of a dragline (1) or an electric shovel, the dragline comprising a boom (4), a bucket (8), a hoist rope (10) from which the bucket is suspended from the boom, and a drag rope (18) for dragging the bucket, the boom extending substantially along a boom axis (BA) in its normal, unstressed state, characterised in that it comprises means (26, 28; 42; 46; 48; 60-70; 76, 80; 82; GPS1-GPS3; 96, 98) for producing alignment data indicative of a lateral alignment, with respect to a plane containing said boom axis (BA), of at least one of the following dragline components:

i) the hoist rope (10), ii) the drag rope (18), iii) the boom (4), iv) the bucket (8), and means for determining said lateral alignment.

23. Apparatus according to claim 22, further comprising control means (32; 34, 72, OP) for controlling said load condition of the dragline (1) or electric shovel on the basis of said alignment data.

24. Apparatus according to claim 22, comprising a man-machine interface (34, 72), e.g. a display device (72), for receiving said alignment data.

25. Apparatus according to claim 23, comprising automated control means (32) for controlling at least one of:

i) the drive (106) of the hoist rope (10), ii) the drive (108) of the drag rope (18), iii) the drive (110) of the boom (4), for swinging the boom, in response to said alignment data.

26. Apparatus according to claim 23, wherein said controlling means (32; 34, 72, OP) are arranged to operate substantially in real time using a feedback of said alignment data.

27. Apparatus according to claim 23, comprising means for commanding a controlled overload of said dragline (1) or electric shovel, notably when controlling a maximum structure stress thereon, as a function of said alignment data.

28. Apparatus according to claim 23, wherein said boom (4) has a specified maximum load limit, and wherein said controlling means (32; 34, 72, OP) comprise means for commanding a controlled overload of the boom above said specified load limit as a function of said alignment data.

29. Apparatus according to claim 22, wherein said means (26, 28; 42; 46; 48; 60-70, 80; 82; GP1-GPS3; 96, 98) for producing said alignment data comprise means for producing quantitative data indicative of an amount of misalignment in at least one said dragline component (4, 10, 18, 8).

30. Apparatus according to claim 22, wherein said means for producing said alignment data comprise means (26, 28) for effecting a measurement on a pulley (6) along which the hoist rope (10) passes to hang from a distal end (4*b*) of the boom (4).

31. Apparatus according to claim 30, wherein said pulley (6) is configured to sway in response to a lateral stress from the hoist rope (10), and wherein said means for producing said alignment data comprise means (100*a*, 26*b*, 28; 38-36, 42, 28) for determining the amount of sway of said pulley.

32. Apparatus according to claim 30, wherein said means for producing said alignment data comprise means (46) for measuring a lateral stress exerted on said pulley (6).

33. Apparatus according to claim 22, wherein said means for producing said alignment data comprise means for acquiring said alignment data by physical contact (46, 48) with at least one said dragline component (4, 8, 10, 18).

34. Apparatus according to claim 33, comprising means (50) physically engaging the hoist rope (10) with an angular or linear displacement sensor device (56-36).

35. Apparatus according to claim 22, wherein said means for producing said alignment data comprise means for detecting a lateral deflection of the boom (4) from said boom axis (BA).

36. Apparatus according to claim 35, comprising a source (60) for generating an optical beam (62), said being attached to the boom (4), preferably at or near a distal end (4*b*), and means (66-70) for detecting a displacement (SD) of the beam spot (65') where it impinges a target (64).

37. Apparatus according to claim 22, wherein said means for producing said alignment data comprise means (42; 48; 50) for imaging at least one said dragline component (4, 8, 10, 18).

38. Apparatus according to claim 37, comprising camera means (76, 80; 82) for imaging the hoist rope (10).

39. Apparatus according to claim 22, wherein said means for producing said alignment data comprise GPS receiver means (GPS1-GPS3), at least one GPS receiver (GPS3) being positioned on said boom (4).

40. Apparatus according to claim 22, wherein said means for producing said alignment data comprise surveying means (96, 98) for determining coordinate evolutions of a portion of the boom (4) susceptible of deflecting laterally with respect to its boom axis (BA).

41. Apparatus according to claim 40, comprising a target (98) substantially at the distal end (4*b*) of the boom, and a surveying device, preferably a self-tracking total station (96) placed at a known reference point on the dragline and aimed at said target.

* * * * *